US006301787B2

(12) United States Patent
Mock

(10) Patent No.: US 6,301,787 B2
(45) **Date of Patent: *Oct. 16, 2001**

(54) SHEAR WITH SLIDING LOCK MECHANISM

(75) Inventor: Mel Corrie Mock, Rocky Ford, GA (US)

(73) Assignee: Cooper Brands, Inc., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,363

(22) Filed: Aug. 13, 1999

(51) Int. Cl.[7] ..... B26B 13/16
(52) U.S. Cl. ..... 30/262; 30/252; 30/261
(58) Field of Search ..... 30/252, 254, 261, 30/262

(56) References Cited

U.S. PATENT DOCUMENTS

| | | | | |
|---|---|---|---|---|
| 2,638,669 | * | 5/1953 | Steede | 30/262 |
| 2,715,270 | * | 8/1955 | Oxhandler | 30/262 |
| 3,416,226 | * | 12/1968 | Pfaffenbach | 30/262 |
| 4,037,276 | * | 7/1977 | Brinker | 30/254 |
| 4,114,268 | | 9/1978 | Hilderbrandt et al. . | |
| 4,156,311 | | 5/1979 | Wallace et al. . | |
| 4,341,016 | * | 7/1982 | Harrison et al. | 30/262 |
| 4,633,587 | * | 1/1987 | Harrison | 30/261 |
| 5,063,671 | | 11/1991 | Huang . | |
| 5,179,783 | | 1/1993 | Melter . | |
| 5,263,254 | | 11/1993 | Orthey . | |
| 5,367,774 | | 11/1994 | Labarre et al. . | |
| 5,377,412 | * | 1/1995 | Schofield et al. | 30/262 |
| 5,463,814 | * | 11/1995 | Stowell et al. | 30/232 |
| 5,469,626 | | 11/1995 | Vogel et al. . | |
| 5,625,952 | * | 5/1997 | Thomas | 30/262 |

* cited by examiner

*Primary Examiner*—M. Rachuba
*Assistant Examiner*—Kim Ngoc Tran
(74) *Attorney, Agent, or Firm*—Coats & Bennett, P.L.L.C.

(57) ABSTRACT

A locking mechanism for scissors-type shear allows closing and locking of the shear even when the locking element is placed in a locked position before the shears are closed. The shear includes first and second blade assemblies pivotably connected to one another. Each blade assembly includes a blade and a handle. A locking mechanism is slidably mounted on a first handle. The locking element is moveable between locked and unlocked positions. In the locked position, the sliding lock mechanism engages a catch element on the second handle to lock the shear in the closed position. The locking mechanism includes resilient arms and the catch element includes inclined cam surfaces. When the locking mechanism is placed in a locked position before the shear is closed, the ends of the resilient arms engage the inclined surfaces of the catch element, allowing the resilient arms to flew outwardly and pass over the catch elements. When the resilient arms return to their original position, the user hears an audible click informing the user that the shears are firmly secured in a closed position.

30 Claims, 6 Drawing Sheets

SHEAR WITH SLIDING LOCK MECHANISM

FIELD OF THE INVENTION

The present invention relates generally to shears of the type having two blades pivotally connected to one another for movement between open and closed positions and, more particularly, to a locking mechanism for a spring-loaded shear to lock the shear in a closing position.

BACKGROUND OF THE INVENTION

The class of cutting tools known as a shear use two opposed and cooperating cutting edges to apply cutting force to a workpiece. Shears and scissors have a wide variety of uses. Shears and scissors are used for cutting paper, fabric, sheet metal, and many other types of sheet material. Shears are also used in gardening for pruning trees, shrubs, and other plants. Perhaps the most common type of shears is the class of shears having two blades with handles, the blades being pivotally connected at their center for pivotable movement between open and closed positions. This class of shears includes scissors and, therefore, shall be referred to herein as a scissors-type shears.

With scissors-type shears, it is common practice to bias the blades to an open position by means of a spring. With spring-biased shears, the user applies cutting force by squeezing the handles of the shears together, causing the blades to close. When the user relieves pressure on the handle, the spring urges the blades to an open position. Thus, the user is not required to apply force to open the blades of the shears. Spring-biased shears typically include a lock mechanism to maintain the blades in a closed position when they are not in use. Locking the blades in a closed position helps prevent damage to the cutting edges of the shears. Additionally, securing the blades in the closed position reduces the risk of injury because the cutting edges are not exposed when the blades are closed.

Many types of locking mechanisms have been devised in the past to secure the blades of scissors-type shears in a closed position. A common type of locking mechanism used in spring-loaded shears is a pivoting latch. Typically, a latch element is pivotally attached to one handle. The latch element includes a notch that engages with a latch pin on the opposing handle. An exemplary pivoting of latch mechanism is shown in U.S. Pat. No. Des. 406,507. Another common type of locking mechanism is a simple loop or bight element attached to one handle that engages a notch in the opposing handle when the shears are in the closed position. This type of locking mechanism is shown in U.S. Pat. No. 5,063,671. The locking mechanisms described above are relatively simple and inexpensive to manufacture. However, these locking mechanisms require two-handed operation: one hand to apply force to hold the shears in a closed position, and one hand to engage the latch or bight element. Also, while consumers may expect these types of locking mechanisms on inexpensive tools, using these mechanisms on more expensive tools could negatively impact sales since consumers may desire a more elegant locking mechanism in higher-priced tools.

Sliding lock mechanisms are also known for locking shears in a closed position. Examples of shears with sliding lock mechanisms are shown in the patent to Wallace et al., U.S. Pat. No. 4,156,311 and LaBarre et al, U.S. Pat. No. 5,367,774. The patent to Wallace discloses a sliding latch that slides back and forth in a slot formed in one of the handles. The opposing handle has a locking stud. The sliding latch slides into and out of engagement with the locking stud to lock and unlock the shears, respectively. The patent to LaBarre discloses a sliding lock mechanism comprising a pin that passes through aligned slots in the handles of the shears. The pin slides within the slots between locked and unlocked positions. The sliding mechanisms exemplified by these patents achieve the desired goal of one-handed operation. However, the sliding mechanisms of the prior art have various limitations. For example, some sliding mechanisms of the prior art do not retain their position during use and tend to interfere with the operation of the shears. Also, many sliding mechanisms are characterized by relatively complex construction having numerous parts. In general, an increase in the number of parts equates to greater material cost. Further, increasing the number of parts usually makes the assembly of the shears more difficult, further increasing the cost of manufacturing the tool. Additional parts also mean more opportunities for wear or failure, reducing the reliability of the tool.

Accordingly, there is a need for a new locking mechanism that is capable of one-handed operation, is simple in construction, and can be inexpensively manufactured.

SUMMARY OF THE INVENTION

The invention is a spring-loaded shear having a one-piece locking mechanism that can be operated with a single hand. The shear comprises first and second blade assemblies that are connected for pivotal movement between open and closed positions. Each blade assembly includes a cutting blade and a handle. A spring biases the blade assemblies to an open position. A simple, one-piece locking mechanism locks the blade assemblies in a closed position when the shear is not being used to protect the blades against damage and to prevent injury to persons.

In a preferred embodiment of the invention, the locking mechanism comprises a sliding latch that moves between a locked position and an unlocked position. The latch is mounted for sliding movement on one of the handles. In the locked position, the sliding latch engages a catch element on the second handle to lock the blade assemblies in a closed position. In the preferred embodiment of the invention, the sliding latch is a molded, u-shaped member, including a thumb pad and two resilient arms. The latch member mounts to the first handle with the thumb pad disposed on an upper surface of the handle and the resilient arms against lateral surfaces of the handle. The resilient arms include latch elements that engage catch elements disposed on the lateral surfaces of the handle.

Also, in a preferred embodiment of the invention, each of the catch elements includes an inclined, cam surface. The cam surfaces allow the blade assemblies to be closed and locked even when the latch member is in the locked position. When the user attempts to close the blade assemblies with the latch member already in a locked position, the resilient arms engage the cam surfaces on the catch elements. The cam surfaces cause the resilient arms to deflect outwardly and pass over the catch element so that the latch element can engage the catch element. Thus, to close and lock the blade assembly, the user simply slides the latch member forward to a locked position and squeezes the handles together. As the resilient arms pass over the catch element and return to their original position, an audible click is produced, alerting the user that the blade assemblies are securely locked in the closed position.

DETAILED DESCRIPTION OF THE INVENTION

Figure 1:
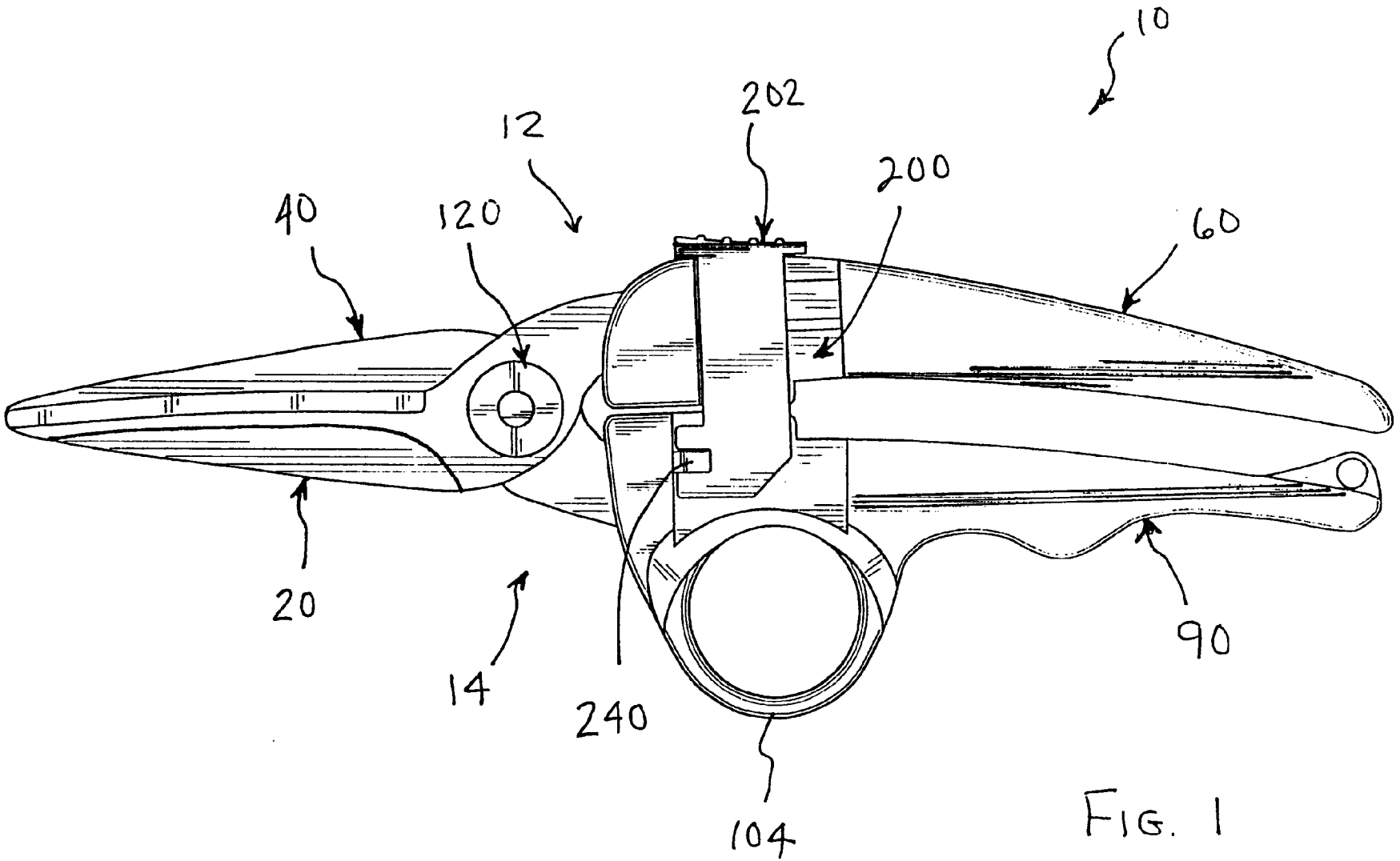
FIG. 1 is a side view of the shear according to the present invention in a closed position.
Figure 2:
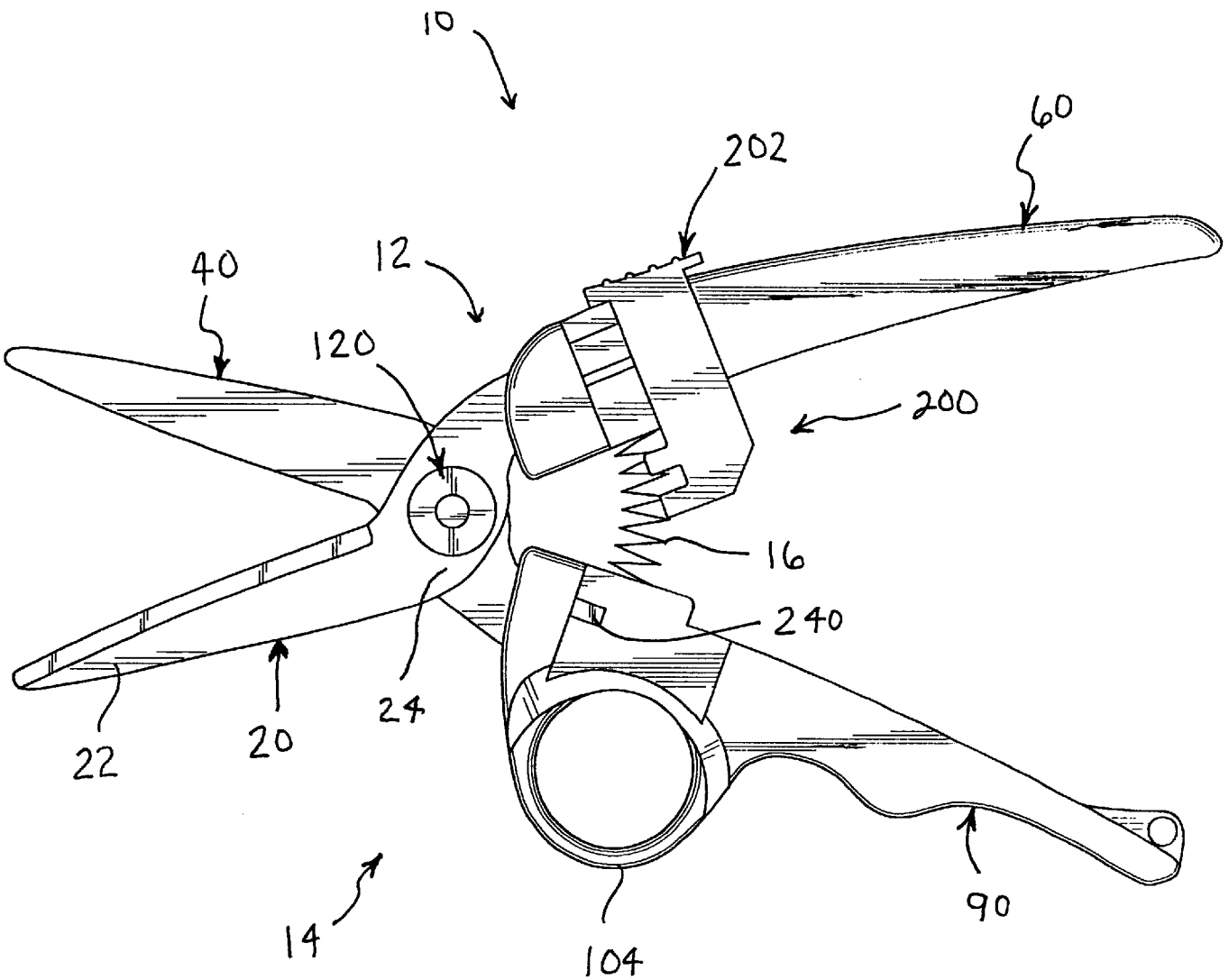
FIG. 2 is a side view of the shear in an open position.
Figure 3:
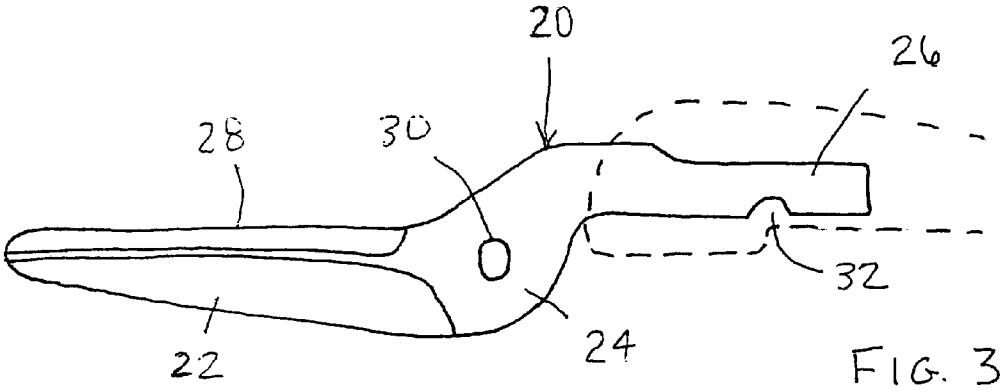
FIG. 3 is a side view of the bottom blade of the shear.
Figure 4:
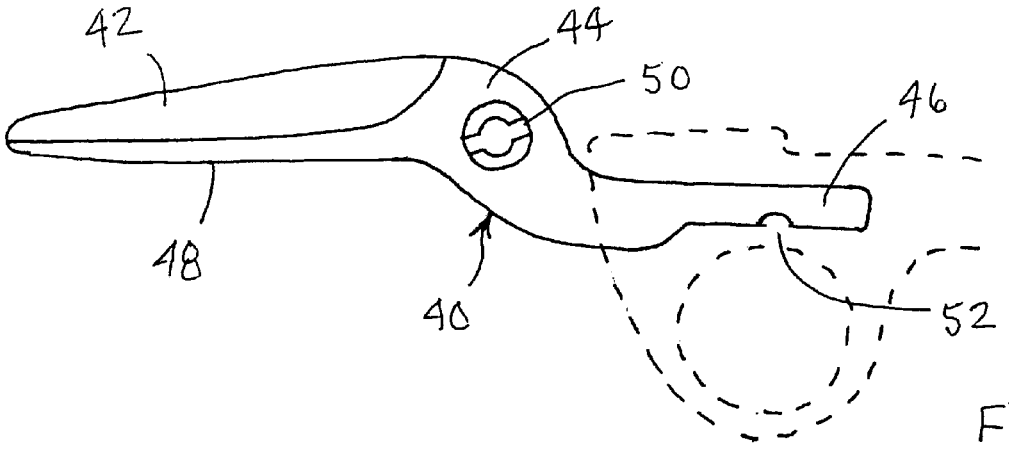
FIG. 4 is a side view of the top blade of the shear
Figure 5:
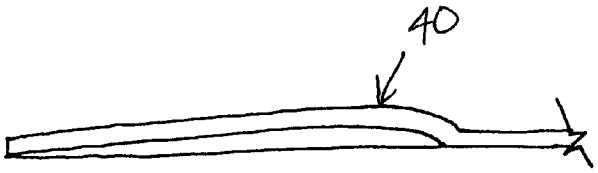
FIG. 5 is a top view of the top blade

Referring now to FIGS. 1 and 2 of the drawings, the spring-loaded shear of the present invention is shown therein and indicated generally by the numeral 10. The shear 10 includes first and second blade assemblies, labeled 12 and 14 respectively, which are pivotably connected by a pivot assembly 120. The first and second blade assemblies pivot between open and closed positions. A biasing member 16, such as a spring, biases the blade assemblies 12, 14 to an open position. A sliding lock mechanism 200 locks the blade assemblies 12, 14 in a closed position against the force of the spring.

The first blade assembly 12 comprises a first blade 20 and a first handle 60. For reference, the first blade 20 is the lower blade of the shear 10 and the first handle 60 is the upper handle of the shear 10. The first blade includes a cutting portion 22, a connecting portion 24, and a shank portion 26. The cutting portion 22 includes a cutting edge 28 formed by grinding. The connecting portion 24 includes a pivot opening to receive a pivot member as will be more fully described below. The shank portion 26 includes one or more notches 32 or openings. The purpose of the notches or openings 32 is to interlock the blade 20 with the first handle 60 during the molding process when the handle 60 is formed.

The first handle 60 includes a top surface 62, lateral surfaces 64, and a bottom surface 68. A step 70 is formed on the bottom surface 68 adjacent the forward end of the handle 60. Step 70 includes a first abutting surface 72 that abuts a corresponding surface on the second handle, as will be described below. The top surface 62 includes a recessed portion, referred to herein as the recessed top surface 74. Similarly, the lateral surfaces 64 include recessed surfaces which are referred to herein as the recessed lateral surfaces 76. As will be described below, the sliding lock mechanism 200 is mounted for sliding movement along the recessed surfaces 74, 76. Shoulder walls 78, 80 are formed along the forward and rearward edges, respectively, of the recessed surfaces 74, 76. The forward shoulder wall 78 functions as a stop to limit the forward movement of the sliding lock mechanism 200. Similarly, the rearward shoulder wall 80 functions as a rearward stop to limit rearward movement of the sliding lock mechanism 200. Thus, shoulder walls 78, 80 define the permissible range of movement of the sliding lock mechanism 200.

A guide rail 82 is formed on the recessed top surface 74. The guide rail 82 extends from the rear shoulder wall 80 to the forward shoulder wall 78. Similarly, guide slots 84 are formed in the recessed lateral surfaces 76. The guide slots 84 extend from the rearward shoulder wall 80 to the forward shoulder wall 78. The primary function of the guide rail 82 is to keep the sliding lock mechanism 200 aligned as it moves along the recessed surfaces 74, 76. The guide slots 84 also help in keeping the sliding lock mechanism 200 properly aligned. In addition, the guide slots 84 also provide a mechanism for retaining the sliding lock mechanism 200 on the first handle 60. This retention function will be described in more detail below.

The second blade assembly 14 comprises a second blade 40 and a second handle 90. For reference, the second blade 40 is the upper blade of the shear 10. Handle 90 is the lower handle of the shear 10. The second blade 40 includes a cutting portion 42, a connecting portion 44, and a shank portion 46. The cutting portion 42 includes a cutting edge 48 formed by grinding. The connecting portion 44 includes a pivot opening 50 to receive a pivot member as described more fully below. Notches or openings 52 in the shank portion 46 interlock with the second handle 90 when the handle 90 is molded to provide a secure attachment between the second blade 40 and second handle 90.

Figure 7:
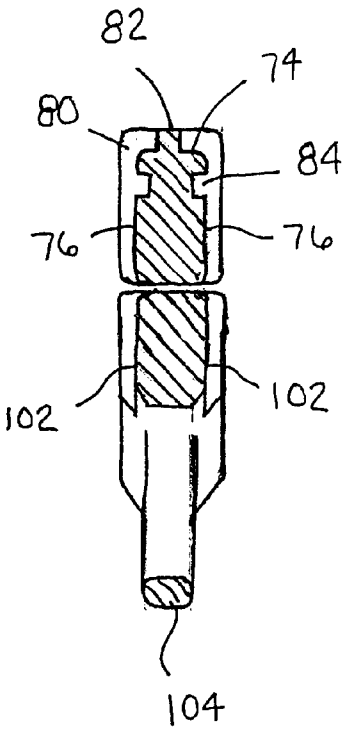
FIG. 7 is a section view of the top and bottom handles taken through line A—A of FIG. 6.
Figure 6:
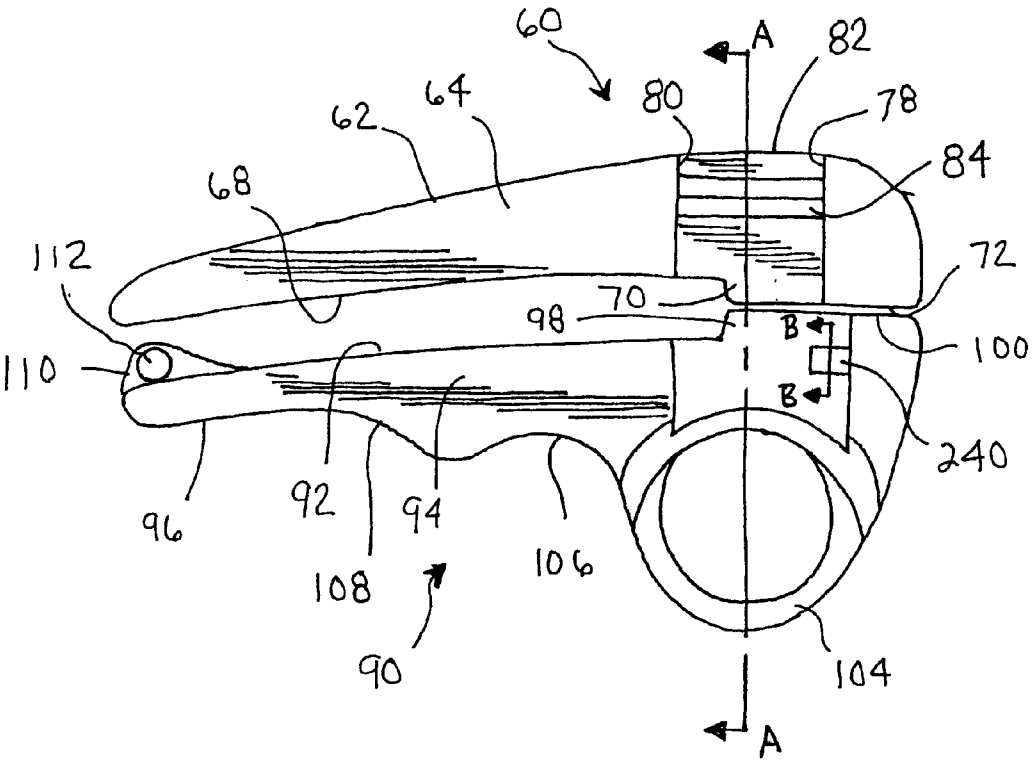
FIG. 6 is a side view of the top and bottom handles of the shear.

The second handle 90 includes a top surface 92, lateral surface 94, and a bottom surface 96. The top surface 92 includes a second step 98 having a second abutting surface 100. The second abutting surface 100 abuts against the first abutting surface 72 when the shear 10 is in the closed position. The purpose of the abutting surfaces 72, 100 is to provide some spacing between the handles 60, 90 when the shear 10 is in the closed position. The lateral surfaces 94 of the second handle 90 include recessed lateral surfaces 102 corresponding to recessed lateral surfaces 76, as shown in FIGS. 6 and 7.

A finger ring 104 is integrally formed on the bottom surface 96 adjacent the forward end of the second handle 90. The finger ring 104 is positioned so that the user's index finger, or pointing finger, is inserted into the finger ring 104 during use. Also, it should be noted that the center of the finger ring 104 is vertically aligned with the center of the recessed lateral surfaces 76 on the upper handle 60. Thus, the finger ring 104 lies centrally along the range of movement of the locking mechanism 200. The relative positioning of the finger ring 104 and the locking mechanism 200 is advantageous from an ergonomic standpoint in that it makes operation of the sliding lock mechanism 200 easier for the user. Also, this arrangement provides a more comfortable feel as compared to other prior art shear 10.

Bottom surface 96 further includes first and second contoured finger surfaces 106, 108. Contoured finger surface 106 accommodates the user's middle finger, while the second contoured finger surface 108 accommodates the ring and little, or pinky, finger. The relative positioning of the finger ring 104 with respect to the sliding lock mechanism 200, and the contoured surfaces 106, 108, provide a more ergonomic and comfortable feel for the user as compared to some prior art shears.

To facilitate storage of the shear 10, a support tab 110 is formed at the rear end of the second handle 90. The support tab 110 could also be formed in the upper handle 60. Support tab 110 includes an opening 112 formed therein. Opening 112 allows the shear 10 to be hung from a peg (not shown). Also, opening 112 can receive a loop made of string used to suspend the shear 10 from a support.

The blade assemblies 12, 14 are pivotably connected by a pivot assembly 120. The construction of the pivot assembly 120 is not a material aspect of the invention. The pivot assembly 120 could be as simple as a bolt and lock nut passing through the aligned pivot openings 30, 50. In the embodiment shown, the pivot assembly 120 includes a bolt, a first bushing, a second bushing, and a thumb nut. The first bushing is press fit into the pivot opening 30 of the first blade 20, and the second bushing is press fit into the pivot opening 50 in the second blade 40. The bolt is inserted through the first bushing and extends through the second bushing. The thumb nut engages the bolt to fasten the components together, completing the assembly.

Another pivot assembly 120 that could be used in connection with the present invention is disclosed in my co-pending U.S. patent application Ser. No. 09/148,781 filed Sep. 4, 1998 and entitled "Adjustable, Quick-Disconnect Pivot Fastener" which is incorporated herein by reference.

Figure 10:
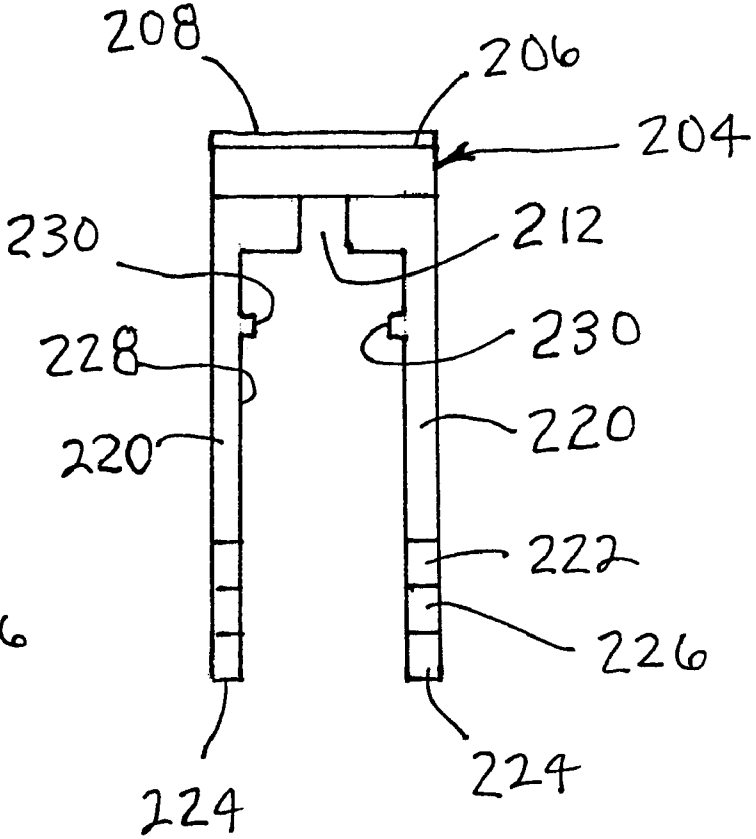
FIG. 10 is a front view of the latch member.
Figure 9:
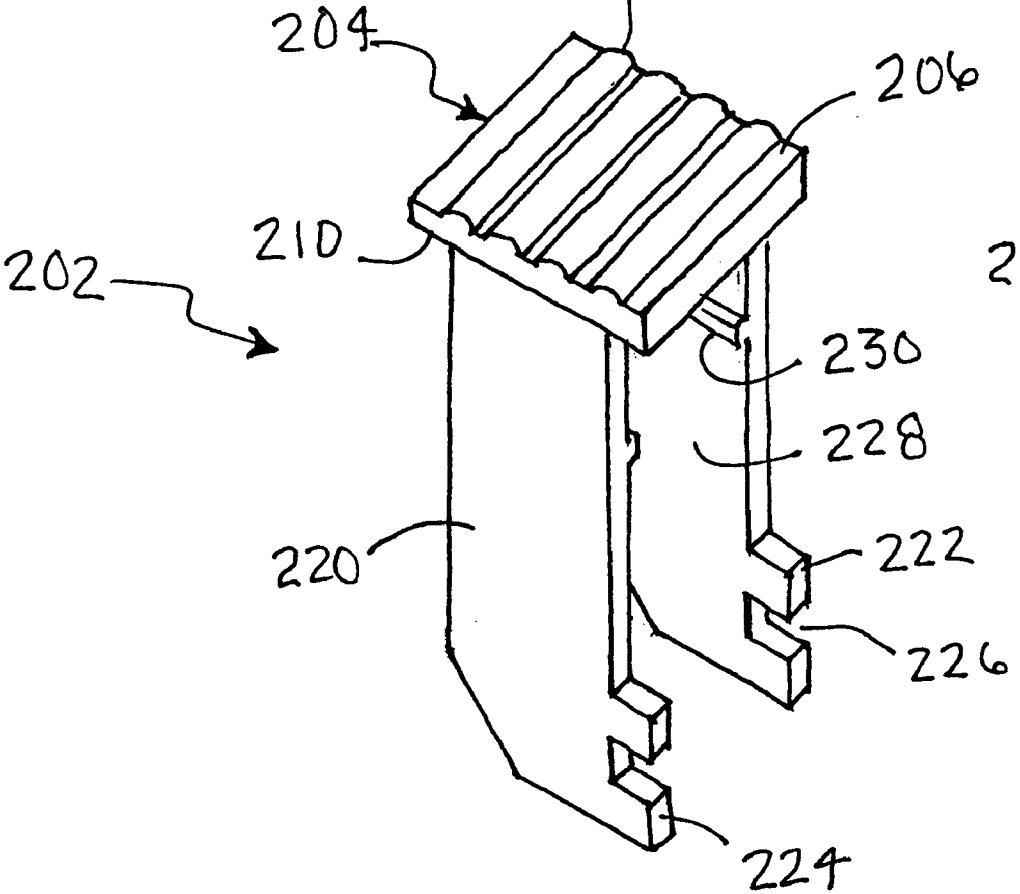
FIG. 9 is a perspective view of the latch member.
Figure 11:
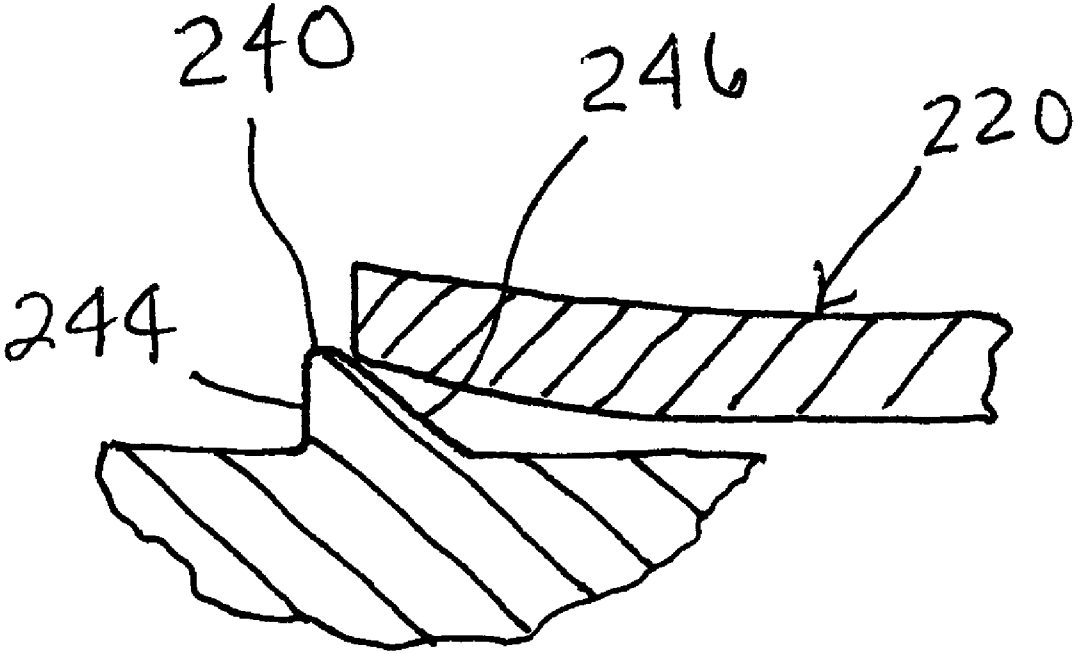
FIG. 11 is a detail section view showing the latch member being flexed outward by the inclined surfaces of the catch element.

Referring now to FIGS. 9–11, the sliding lock mechanism 200 is shown. The sliding lock mechanism 200 comprises a latch member 202 and a pair of catch elements 240. The latch member 202 is mounted to the first handle 60. The catch elements 240 are formed on the recessed laterals surface of the second handle 90. The latch member 202 slides forward and backward into and out of engagement with the catch elements 240.

The latch member 202 includes a thumb tab 204 and two spaced-apart resilient latch arms 220. The latch member 202 is mounted to the first handle 60 so that the thumb tab 204 occupies the area defined by the recessed top surface 74, and the resilient latch arms 220 occupy the area defined by the recessed lateral surfaces 76. The resilient arms 220 are disposed on opposing sides of the first handle 60 so that the first handle 60 is, in effect, captured between the resilient arms 220.

The thumb tab 204 has a top surface 206 that inclines upwardly from the rear of the tab 204 to the front of the tab 204. Ridges 208 extend across the tab from one side thereof to the other. The function of the ridges 208 is to prevent the user's thumb from slipping on the top surface 206 when pressure is applied to the thumb tab 204 by the user. The inclination of the top surface 206 enables greater force to be applied in the forward direction. The bottom surface 210 is substantially flat and smooth so as to slide easily over the recessed top surface 74. A guide slot 212 is formed in the bottom surface 210 of the thumb tab 204. The guide slot 212 mates with the guide rail 82 on the recessed top surface 74 of the upper handle 60. The guide slot 212 and guide rail 82 cooperate to keep the latch member 202 properly aligned as it is moved between the locked and unlocked positions.

The resilient latch arms 220 are identical in construction. Each latch arm 220 extends downward in cantilever fashion from the bottom surface 210 of the thumb tab 204. A pair of spaced-apart prongs 222, 224 are formed at the free end of the resilient arms 210. The prongs 222, 224 define a catch area 226. When the blade assemblies 12, 14 are in a closed position and the lock mechanism 200 is moved to the locked position, the catch element 240 on the recessed lateral surfaces 102 are captured in the catch areas 226 of the resilient arms 220.

The inner surfaces 228 of the resilient arms 220 are preferably smooth to allow for easy sliding movement of the lock mechanism 200 over the recessed lateral surfaces 76, 102. Each resilient arm 220 includes an integrally formed guide rail 230 which is formed on the inner surface 228. The guide rails 230 fit within the guide slots 84 in the recessed lateral surfaces 76 of the first handle 60. The guide rails 230 sliding within the guide slots 84 help to keep the latch member 202 aligned as it is moved between the locked and unlocked positions. Additionally, the guide rails 230 and guide slots 84 cooperate to retain the latch member 202 on the first handle 60. During assembly, the first handle 60 is inserted between the resilient arms 220 of the latch member 202. As the first handle 60 is inserted, the resilient arms 220 must be spread apart slightly to allow the guide rails 230 to pass over the portion of the recessed lateral surfaces 76 above the guide slot 84. When the handle 60 is fully inserted, the guide rails 230 will align with the guide slots 84 in the recessed lateral surfaces 76. When the guide rails 230 align with the guide slots 84, the resilient arms 210 will return to their normal position and the guide rails 230 will engage in the guide slots 84. This engagement securely attaches the latch member 202 to the upper handle 60.

Figure 8:
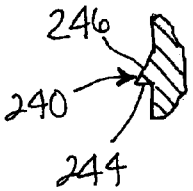
FIG. 8 is a detail section view of the bottom element through line B—B of FIG. 6.

The catch elements 240 comprise small triangular protrusions on the opposing recessed lateral surfaces 102 as seen in FIGS. 8 and 11. The catch elements 240 have a generally triangular cross-section with a substantially vertical locking surface 244 facing downward and an aligned cam surface 246 facing upward. When the blade assemblies 12, 14 are in the closed position and the lock mechanism 200 is pushed forward to the locked position, the lower prong 224 engages the locking surface 244 and, thus, functions as a latch element. As previously noted, when the latch member 202 is in the locked position, the catch element 240 is captured between the upper and lower prongs 222, 224. To unlock the shear 10, the latch member 202 slides rearwardly to an unlocked position so that the prongs 224 on the resilient arms 220 clear the catch elements 240 on the second handle 90. When the latch member 202 is in the unlocked position, the spring 16 pushes the blade assemblies 12, 14 apart to the open position.

One advantage of the present invention is that the shear 10 can be closed and locked even when the locking mechanism 200 is in a locked position. For purposes of explanation, assume that the blade assemblies 12, 14 are pushed apart by the spring 16 to the open position and that the latch member 202 is in the forward or locked position. When the user attempts to close the shear 10, the bottom ends of the resilient arms 220 will engage the inclined cam surfaces 246 of the catch elements 240 as seen in FIG. 11. The cam surfaces 246 will cause the resilient arms 220 to spread apart or flex outward so that the lower prong 224 passes over the top of the catch element 240.

Once the lower prong 224 passes over the catch element 240, the resilient arms 220 return to their original undeformed condition and the lower prongs 224 engage the locking surfaces 244 of the catch elements 240. As the resilient arms 220 return to their un-deformed condition, the user will hear an audible click informing the user that the shear 10 is securely locked in the closed position.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A cutting device comprising:

a. a first blade assembly having a first cutting blade and a first handle;

b. a second blade assembly mounted to said first blade assembly, said second blade assembly having a second cutting blade and a second handle;

c. a substantially U-shaped latch member slidably engaged on said first handle and movable along an axis between locked and unlocked positions, said latch member having a pair of arms positioned along first and second sides of said first handle, each of said arms comprising an interior sliding surface to move along said first handle, each of said arms further having prongs forming a catch area and a catch surface aligned substantially perpendicular to said sliding surface;

d. catch elements extending outward from first and second sides of said second handle, each of said catch elements having a first ramped surface and a second contact surface, said first and second surfaces forming an acute angle with each of said second contact surfaces extending substantially perpendicular from said first and second sides respectively, said contact surfaces and said catch surfaces contacting when said handle is in a locked position; and e. a finger ring extending downward from said second handle, a center of said finger ring being substantially aligned with said latch member's range of motion between said locked and unlocked positions such that a line from said center and perpendicular to said axis intersects said axis between said locked and unlocked positions.

2. A pair of shears comprising:

a. a first blade assembly having a first cutting blade and a first handle;

b. a second blade assembly having a second cutting blade and a second handle, said first and second blade assemblies being connected for pivotal movement between an open position and a closed position;

c. a biasing member for biasing said first and second blade assemblies to the open position;

d. a resilient latch member mounted to said first handle for sliding movement along an axis between locked and unlocked positions;

e. a catch element on said second handle to engage the latch member on the first handle when blade assemblies are in the closed position and the latch member is in the locked position;

f. a cam surface formed on said catch element to engage the resilient latch member allowing it to flex outward and pass over said catch element when the latch member is in the locked position, wherein said latch member returns to its original un-deformed condition after passing over said catch element; and g. a finger ring extending downward from said second handle, a center of said finger ring being aligned with said latch member's range of motion between said locked and unlocked positions such that a line from said center and perpendicular to said axis intersects said axis between said locked and unlocked positions.

3. The shears of claim 2 wherein said latch member comprises a thumb pad and at least one resilient latch arm extending from said thumb pad.

4. The shears of claim 3 wherein said thumb pad is positioned on a top surface of said first handle.

5. The shears of claim 4 wherein said latch member has two spaced apart latch arms extending from said thumb pad, said latch arms disposed on opposing sides of said first handle.

6. The shears of claim 1 wherein the finger ring is positioned at a forward end of said second handle.

7. The shears of claim 2 wherein one of said first and second handles includes an opening at the rear end for hanging said shears from a support.

8. The shears of claim 2 wherein said biasing member is a spring.

9. The shears of claim 2 wherein said first and second handles include opposed abutting surfaces that abut when the blade assemblies are in the closed position.

10. The shears of claim 2 further including a guide member formed on said first handle to guide said latch member as the latch member moves between locked and unlocked positions.

11. The shears of claim 10 wherein said guide member comprises a guide rail, said latch member being mounted for forward and backward movement along said guide rail.

12. The shears of claim 11 wherein said latch member includes a guide slot that mates with said guide rail on said first handle.

13. The shears of claim 11 wherein said guide rail is on an upper surface of said first handle.

14. The shears of claim 10 wherein said guide member comprises at least one guide slot formed in said first handle, said latch member being mounted for forward and backward movement along said guide slot.

15. The shears of claim 14 wherein said latch member includes at least one guide rail that slides within said guide slot in said first handle.

16. The shears of claim 14 wherein said guide slot is disposed on a lateral surface of said first handle.

17. The shears of claim 16 wherein said latch member includes a resilient latch arm extending along said lateral surface, said guide rail disposed on said latch arm.

18. The shears of claim 16 wherein said first handle includes two guide slots on opposing lateral surfaces thereof, and wherein said latch member includes two spaced-apart resilient latch arms disposed on opposing sides of the first handle, each latch arm including a guide rail that slides within a respective guide slot on said first handle.

19. The shears of claim 10 further including at least one stop to limit the movement of said latch member.

20. The shears of claim 10 including two stops to limit the movement of said latch member in forward and backward directions respectively.

21. The shears of claim 20 wherein said first and second cutting blades are cambered.

22. A cutting device comprising:

a. a first blade assembly having a first cutting blade and a first handle;

b. a second blade assembly movably connected to said first blade assembly, said second blade assembly having a second cutting blade and a second handle;

c. a resilient latch member mounted to said first handle for sliding movement between locked and unlocked positions, said resilient latch member further including a contact surface;

d. a catch element extending outward from said second handle, said catch element having a first ramped surface and a second surface extending outward substantially perpendicular to said second handle;

e. said resilient latch member contact surface abutting against said catch element second surface for maintaining the blades together in said locked position; and f. said resilient latch member having a distal portion adapted, when said first handle is fully moved towards said second handle with said latch member in said locked position, to travel over said ramped surface in a direction generally parallel with the movement of said first handle.

23. The device of claim 22, wherein a catch element extends outward from each of first and second sides of said second handle, said resilient latch member is substantially U-shaped having an arm extending along each of first and second sides of said first handle to contact each of said catch elements.

24. The device of claim 23, wherein each arm of said resilient latch member includes a pair of prongs, said prongs straddling said catch elements in said locked position.

25. A cutting device comprising:

a. a first blade assembly having a first cutting blade and a first handle, said first handle comprising a sliding surface and a catch element, said catch element comprising a contact surface extending substantially perpendicularly outward from said sliding surface;

b. a second blade assembly pivotably mounted to said first blade assembly and comprising a second cutting blade and a second handle;

c. a latch mechanism movably mounted on said second handle, said latch mechanism comprising a thumb tab positioned on a top edge of said second handle and a resilient arm extending therefrom and having a substantially smooth first surface for contacting said first handle sliding surface, said resilient arm further comprising a catch surface positioned substantially perpendicular to said sliding surface, said catch surface abutting against said contact surface when said handle is in a locked position.

26. The cutting device of claim 25, wherein said catch surface has a thickness substantially equal to said contact surface.

27. The cutting device of claim 25 wherein said thumb tab and resilient arm are jointly slidable between a locked and unlocked position relative to said second handle; and wherein said arm has a distal portion adapted, when said second handle is fully moved towards said first handle with said resilient arm in said locked position, to travel over a ramped surface on said first handle in a direction generally parallel with the movement of said second handle.

28. The cutting device of claim 27 wherein said resilient arm comprises a pair of prongs, said prongs adapted to straddle said contact surface of said first handle when said second handle is fully moved towards said first handle with said resilient arm in said locked position.

29. The cutting device of claim 25 wherein said thumb tab and resilient arm are jointly slidable between a locked and unlocked position relative to said second handle; and wherein:

said resilient arm allows said first handle to be locked relative to said second handle by moving said second handle towards said first handle with said resilient arm in said locked position;

said resilient arm allows said first handle to be locked relative to said second handle by moving said resilient arm from said unlocked position to said locked position with said second handle pressed against said first handle;

said resilient arm in said locked position substantially prevents said first handle from being moved away from said second handle due to said catch surface abutting said contact surface; and said resilient arm in said unlocked position allows said first handle to be moved away from said second handle.

30. The cutting device of claim 25 wherein said thumb tab and resilient arm are jointly slidable between a locked and unlocked position relative to said second handle; and wherein:

the interaction of said catch element and said resilient arm allows said handles to be locked closed by moving said second handle towards said first handle with said resilient arm in said locked position;

the interaction of said catch element and said resilient arm allows said handles to be locked closed by moving said resilient arm from said unlocked position to said locked position after closing said handles with said resilient arm in said unlocked position; and the interaction of said catch element and said resilient arm substantially prevents said handles from being opened unless said resilient arm is in said unlocked position.

* * * * *